US008286375B2

(12) United States Patent
Tack

(10) Patent No.: US 8,286,375 B2
(45) Date of Patent: Oct. 16, 2012

(54) DRAG HEAD OF A TRAILING SUCTION HOPPER DREDGER AND METHOD FOR DREDGING USING THIS DRAG HEAD

(75) Inventor: Bruno Tack, Assenede (BE)

(73) Assignee: Dredging International N.V., Zwijndrecht (BE)

( * ) Notice: Subject to any disclaimer, the term of this patent is extended or adjusted under 35 U.S.C. 154(b) by 47 days.

(21) Appl. No.: 12/745,381

(22) PCT Filed: Oct. 31, 2008

(86) PCT No.: PCT/EP2008/064787

§ 371 (c)(1), (2), (4) Date: Jun. 29, 2010

(87) PCT Pub. No.: WO2009/068412

PCT Pub. Date: Jun. 4, 2009

(65) Prior Publication Data

US 2010/0299972 A1 Dec. 2, 2010

(30) Foreign Application Priority Data

Nov. 29, 2007 (BE) ..... 2007/0572

(51) Int. Cl.
*E02F 3/94* (2006.01)

(52) U.S. Cl. ..... 37/318

(58) Field of Classification Search ..... 37/307–344
See application file for complete search history.

(56) References Cited

U.S. PATENT DOCUMENTS

| | | | | | |
|---|---|---|---|---|---|
| 724,501 | A | * | 4/1903 | Reno | 37/333 |
| 1,068,934 | A | * | 7/1913 | Sackett | 37/333 |
| 1,169,745 | A | * | 1/1916 | Haddon | 209/250 |
| 1,263,829 | A | * | 4/1918 | Wintersgil | 37/318 |
| 1,729,054 | A | * | 9/1929 | Shotwell | 37/333 |
| 1,840,606 | A | * | 1/1932 | Scheffauer | 37/333 |
| 1,849,800 | A | * | 3/1932 | Hodge | 209/250 |
| 1,964,951 | A | * | 7/1934 | Kertzman | 37/318 |
| 2,205,490 | A | * | 6/1940 | Peterson | 37/308 |
| 2,774,569 | A | * | 12/1956 | Jacobsen | 37/318 |

(Continued)

FOREIGN PATENT DOCUMENTS

DE 3817213 C1 * 1/1989

(Continued)

OTHER PUBLICATIONS

International Search Report, for International Application No. PCT/EP2008/064787: search completed Jan. 16, 2009, mailed Feb. 2, 2009.

*Primary Examiner* — Thomas B Will
*Assistant Examiner* — Joan D Misa
(74) *Attorney, Agent, or Firm* — Novak Druce + Quigg LLP

(57) ABSTRACT

A drag head of a trailing suction hopper dredger. The drag head comprises a rotatable visor connected to a suction pipe for discharging soil via the suction opening of the visor, wherein the visor is provided with a catching construction for undesirable objects. The catching construction closes the suction opening except for passage openings, wherein at least a number of passage openings have a variable passage area. A method for breaking up and/or dredging at least partially hard grounds under water using a trailing suction hopper dredger equipped with a drag head.

18 Claims, 5 Drawing Sheets

U.S. PATENT DOCUMENTS

| | | | | | |
|---|---|---|---|---|---|
| 3,305,950 | A | * | 2/1967 | Hirshman et al. | 37/311 |
| 3,802,740 | A | * | 4/1974 | Sullivan | 299/8 |
| 3,965,687 | A | * | 6/1976 | Shaw | 405/226 |
| 3,975,054 | A | * | 8/1976 | Brockett et al. | 299/8 |
| 3,975,842 | A | * | 8/1976 | Andreae | 37/322 |
| 4,070,061 | A | * | 1/1978 | Obolensky | 299/8 |
| 4,083,134 | A | * | 4/1978 | Oterdoom | 37/333 |
| 4,123,859 | A | * | 11/1978 | de Koning | 37/325 |
| 4,150,502 | A | * | 4/1979 | Sijthoff | 37/333 |
| 4,265,035 | A | * | 5/1981 | Goedvolk | 37/333 |
| 4,365,427 | A | | 12/1982 | Chapman, Jr. | |
| 4,367,601 | A | * | 1/1983 | Latimer et al. | 37/318 |
| 4,521,305 | A | * | 6/1985 | Deal | 210/158 |
| 5,421,105 | A | * | 6/1995 | Schulte | 37/309 |
| 5,732,487 | A | * | 3/1998 | Van De Kerckhove | 37/333 |
| 6,364,119 | B1 | | 4/2002 | Graham | |
| 2006/0150445 | A1 | * | 7/2006 | Redding | 37/317 |
| 2007/0261275 | A1 | * | 11/2007 | Tack | 37/335 |

FOREIGN PATENT DOCUMENTS

| | | | | |
|---|---|---|---|---|
| EP | 0 892 116 | A | | 1/1999 |
| GB | 1913 26384 | A | | 0/1914 |
| GB | 2128663 | A | * | 5/1984 |
| JP | 61 126227 | A | | 6/1986 |
| JP | 03151422 | A | * | 6/1991 |
| SU | 717385 | | * | 2/1980 |
| SU | 1170067 | | * | 7/1985 |
| SU | 1 573 101 | A1 | | 6/1990 |

* cited by examiner

Prior Art

DRAG HEAD OF A TRAILING SUCTION HOPPER DREDGER AND METHOD FOR DREDGING USING THIS DRAG HEAD

CROSS-REFERENCE TO RELATED APPLICATIONS

This application is a §371 national stage entry of International Application No. PCT/EP2008/064787, filed Oct. 31, 2008, which claims priority to Belgian Patent Application No. 2007/0572, filed Nov. 29, 2007, both of which are hereby incorporated by reference.

BACKGROUND

The invention relates to a drag head of a trailing suction hopper dredger according to the preamble of claim 1. The invention relates more particularly to a drag head which comprises a rotatable visor connected to a suction pipe for discharging soil via the suction opening of the visor.

Such a drag head is known, for instance from EP-A-0892116. Described herein is a drag head consisting of a visor connected to a suction pipe. The visor generally has an upper wall and two side walls and is open on the underside, thereby creating a suction opening for the discharge of soil. The whole is fixed to the trailing suction hopper dredger by means of a drag pipe. In order to enable dredging of ground under water, the drag head is lowered with drag pipe and suction pipe under water at the position of the rear side of the trailing suction hopper dredger until it contacts the bottom under the influence of its own weight. The drag head is dragged over the bottom for dredging by the movement of the trailing suction hopper dredger, wherein the soil is loosened and is suctioned away with water via the suction pipe. The trailing suction hopper dredger is provided for this purpose with a suction pump. The loosening of the ground is facilitated in the known drag head by providing the visor with a series of teeth, which are generally arranged transversely of the sailing direction on a so-called toothed beam and which penetrate partially into the ground during the dredging. Water under pressure is also injected into the ground in order to fluidize it. All these measures are intended to increase the dredging efficiency, which in this application is understood to mean the volume of soil dredged per unit of time.

If the known drag head is applied on harder grounds, such as for instance in sandstone, coral, rock or highly compacted mud, large hard chunks can result during dredging due to the action of the teeth, and these are suctioned up in their entirety and may block the suction pipe or even damage or put the suction pump out of operation. Many grounds for dredging are also strewn with armaments, such as bombs. In order to avoid such undesirable objects causing problems, the known drag head, and more particularly the visor thereof, is provided with a catching construction in the form of for instance a grid. Such a framework of rods running crosswise, between which passage openings are situated, prevents undesirable objects which are larger than the passage openings from entering the suction pipe. It has however been found that this has an adverse effect on the dredging efficiency. A decrease in the dredging efficiency is caused, among other factors, by a part of the suction opening of the visor becoming blocked by the undesirable objects, whereby increasingly less soil can be suctioned up. The drag head must then be brought to the surface and cleaned, which takes up valuable time.

SUMMARY OF THE INVENTION

The present invention has for its object to provide a drag head of a trailing suction hopper dredger which provides adequate protection against the suctioning up of undesirable objects without this adversely affecting the dredging efficiency.

The drag head according to the invention comprises for this purpose a visor provided with a catching construction for undesirable objects, which catching construction closes the suction opening except for passage openings, wherein at least a number of passage openings have a variable passage area. Surprisingly achieved by providing a number of passage openings with a variable passage area is that the suction opening becomes blocked less quickly, or even not at all. Objects which have come to lie in the catching construction are also released again easily.

The known grid is greatly deformed and/or damaged during use. This is caused by the undesirable objects being drawn against the grid with great force (by the great suction force of the suction pump of the trailing suction hopper dredger and the own weight of the drag head and drag pipe) and becoming firmly lodged therein. Not only is removal difficult, but larger holes may also be created in the grid and/or between grid and visor side walls due to the deformation of the grid, whereby undesirable objects are no longer stopped. It has been found that the catching construction according to the invention deforms less than the known grid.

A preferred embodiment of the drag head according to the invention is characterized in that at least a number of passage openings have a passage area which can be enlarged. It has been found that such a preferred embodiment not only further reduces the necessity for cleaning, but also achieves that undesirable objects, even in the unlikely event they do become jammed in the catching construction, can be removed relatively easily therefrom.

A further preferred embodiment of the drag head according to the invention has the feature that the catching construction comprises a framework of rods which run crosswise and between which the passage openings are situated, wherein at least some of the rods are connected movably to the visor. A first series of rods is here preferably connected fixedly to the visor and a second series of rods connected movably to the visor. The first series of rods connected fixedly to the visor provides the necessary strength and rigidity of the catching construction. The second series of (movable) rods ensures that at least a number of passage openings between the rods have a variable passage area. It is noted that the rods are not necessarily cylindrical but can have any random cross-section. A further advantage of the present embodiment is that possibly damaged detachable elements can be replaced much more quickly than fixed components due to the fact that they are not fixed.

It is also advantageous to characterize the drag head according to the invention in that the second series of rods is connected movably to the first series of rods by means of a coupling slidable between two end stops arranged on the first series of rods. A rod of the second series can hereby slide over a rod of the first series, but only over a limited distance. The distance is determined by the position of the end stops, which is moreover adjustable in this preferred variant. In this preferred variant the number of end stops, the mutual distance therebetween and the number of rods of the second series can all be readily adapted to the conditions. The catching construction can thus easily be made suitable for the purpose of stopping bombs or for stopping rocks. A catching construction for bombs typically has passage areas of 10×10 cm, where a catching construction for rocks for a larger drag head must typically have passage areas of 40×30 cm. A catching construction for rocks is obtained from a catching construction for bombs in simple manner by removing therefrom a number of rods of the first series. This is also reversible.

The same advantages as stated above can be gained by characterizing the drag head according to the invention in that the second series of rods is connected movably to the first series of rods by means of a coupling slidable between two sleeves arranged on the first series of rods. A rod of the second series can hereby slide over a rod of the first series, but only over a limited distance, wherein the distance is determined by the length of the sleeves.

The drag head according to the invention preferably comprises a visor which is provided with a series of teeth which are arranged transversely of the sailing direction and which penetrate partially into the ground during dredging. Such a series of teeth regularly causes problems in the known drag head because undesirable objects, such as large rocks, become lodged between the grid and the teeth. This is less the case with the drag head according to the invention.

It is further advantageous when the catching construction of the drag head according to the invention is provided with a series of teeth. Such a series of teeth is preferably arranged on the first series of rods because these rods form part of the bearing construction of the visor and can therefore transmit considerable forces. The teeth of the present preferred variant are preferably arranged offset on the catching construction. For a given cutting distance (the distance between furrows made in the ground) the mutual distance between the teeth is thus increased. This reduces the chance of undesirable objects becoming lodged between the teeth.

In a further preferred embodiment of the drag head according to the invention the visor is provided with wear strips at the position of the underside of the side walls. Depending on the ground conditions these wear strips can be knife-like and therefore sufficiently thin to penetrate the ground. An at least partial lateral sealing is hereby realized. The distance from between the catching construction and the ground is preferably also adjusted using the wear strips. The distance between the catching construction and the ground can for instance thus be increased if it is found during use that the catching construction wears too quickly or is still in danger of becoming blocked. If desired, the catching construction according to the invention is provided with a series of jet pipes for ejecting a medium, for instance water, under pressure in order to fluidize the ground, break up and/or transport undesirable objects, or for other reasons. The jet pipes—and therefore also the outflowing jet—can here be directed toward the interior of the visor, for instance at the teeth, or be directed downstream, although it is also possible to provide jet pipes which are directed substantially vertically or almost vertically downward, all subject to the specific conditions of the ground for dredging.

The invention also relates to a method for breaking up and/or dredging at least partially hard grounds under water using a trailing suction hopper dredger equipped with a drag head according to the invention. The invented drag head makes it possible in simple manner to free the catching construction of undesirable objects should they nevertheless come to lie in the catching construction. The method comprises for this purpose a step in which the drag head is lifted from the bottom and/or in which the suction action is temporarily reduced or deactivated. Owing to the ingenious construction of the invention undesirable objects are here readily released from the catching construction. Obstructions can hereby be removed by simply interrupting the suction process, where this can seldom be achieved with a standard fixed catching structure. In this latter case the drag head must be brought back on board after a time in order to remove the obstructions manually. Since it is not necessary to do this with the catching construction according to the invention, the use thereof means a significant gain in dredging time.

BRIEF DESCRIPTION OF THE DRAWINGS

The invention will now be further elucidated with reference to the following figures and description of preferred embodiments, without the invention otherwise being limited thereto. In the figures:

FIG. 7 is a perspective bottom view of a part of the embodiment variant shown in

FIG. 4.

DETAILED DESCRIPTION

Figure 1:
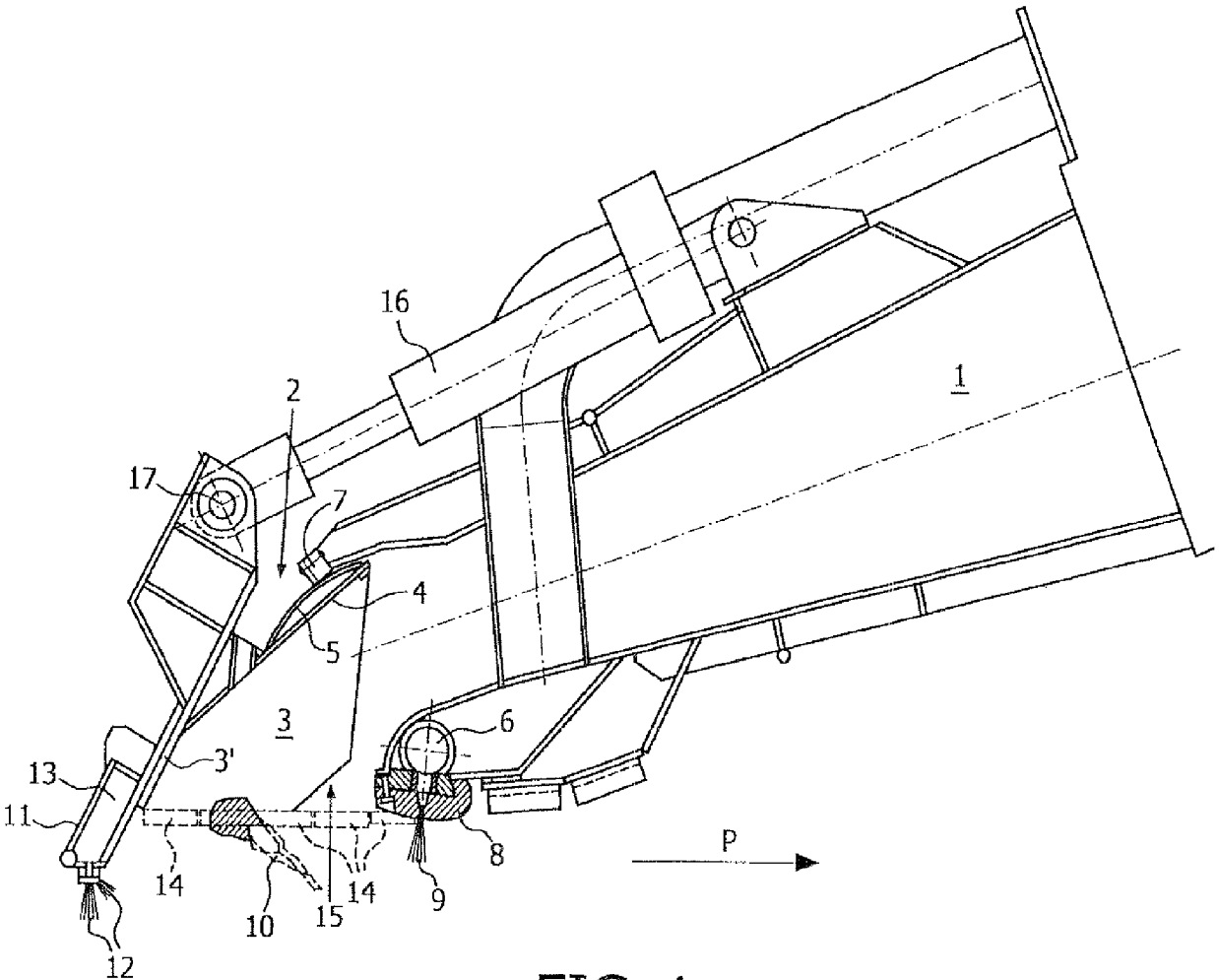
FIG. 1 shows schematically a drag head of a trailing suction hopper dredger.

Referring to FIG. 1, a drag head is shown which is moved in the direction of arrow P over a bottom for dredging by a trailing suction hopper dredger (not shown). The drag head comprises a visor 2 connected to a suction pipe 1. Visor 2 is provided with, among other parts, side walls 3, a rear wall 3' and a top plate 4 with an arcuate part 5 which, when visor 2 rotates around rotation shaft 6, remains in close contact with sealing strip 7. The drag head rests with heel plate 8 on the bottom during dredging. If desired, heel plate 8 can be provided with a number of jet pipes 9 which inject water under pressure into the bottom for fluidization thereof. Downstream of heel plate 8 visor 2 is provided with a series of teeth 10 which are arranged on a toothed beam and which ensure that the ground is cut open. A second series of jet pipes 12 can optionally be arranged further downstream for the purpose of there also fluidizing the ground at greater depth. Jet pipes 12 are connected to a height-adjustable chamber 11 provided with water 13. During dredging an underpressure is maintained inside suction pipe 1 and visor 2 by a suction pump (not shown), whereby the loosened soil particles are discharged through suction pipe 1 via suction opening 15 of visor 2. For the purpose of proper lateral sealing thereof, visor 2 is preferably further provided with laterally running, knife-like wear strips 14 arranged on the underside of side walls 3. Visor 2 is raised or lowered around rotation shaft 6 by means of hydraulic cylinder 16. Cylinder 16 is connected fixedly relative to the drag head and is connected hingedly to rear wall 3' of visor 2 by means of a hinge coupling 17.

Figure 2:
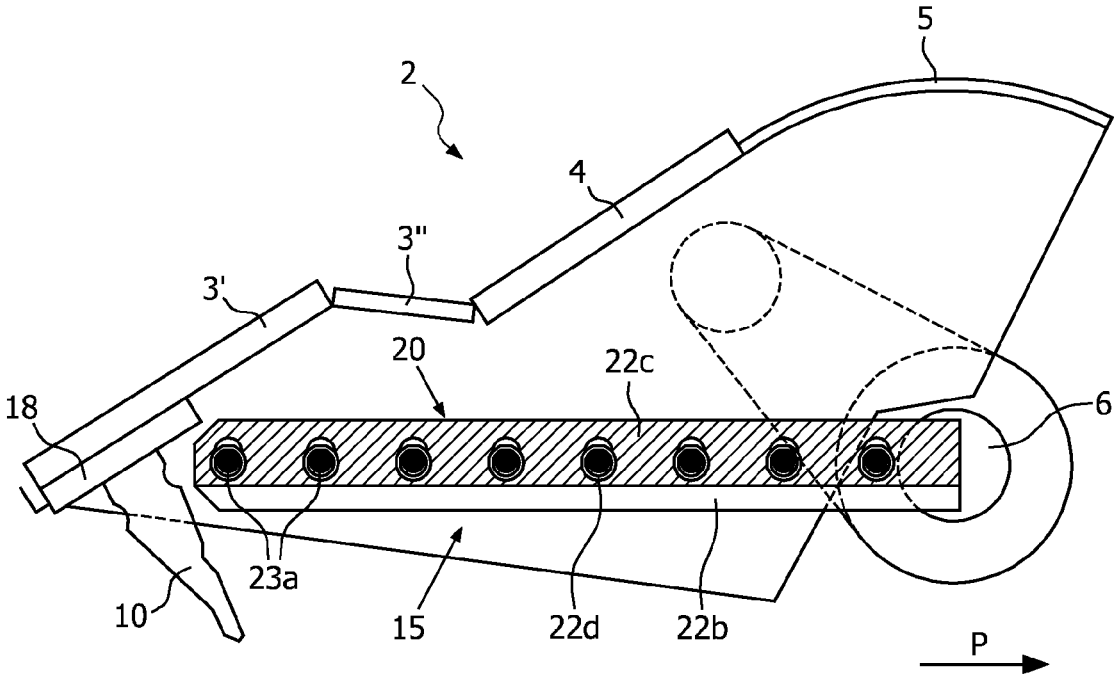
FIG. 2 shows a cross-section of a drag head according to the invention.
Figure 3:
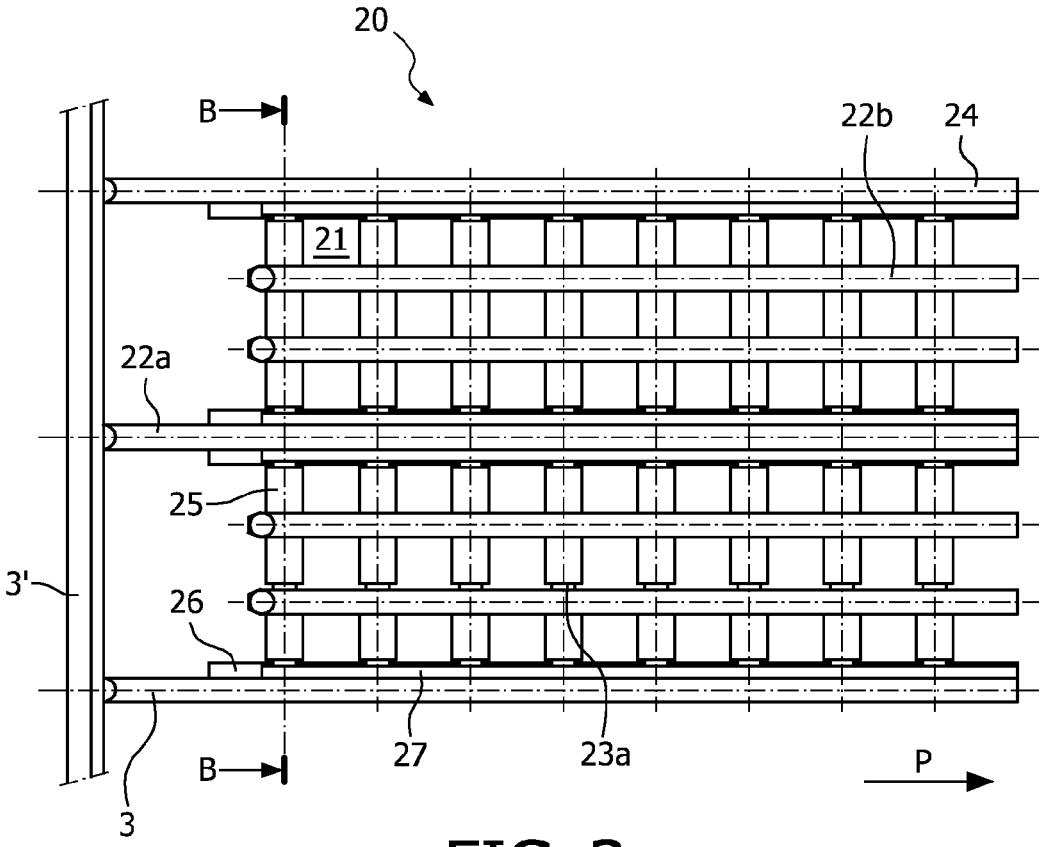
FIG. 3 is a bottom view of the drag head shown in FIG. 1.
Figure 4:
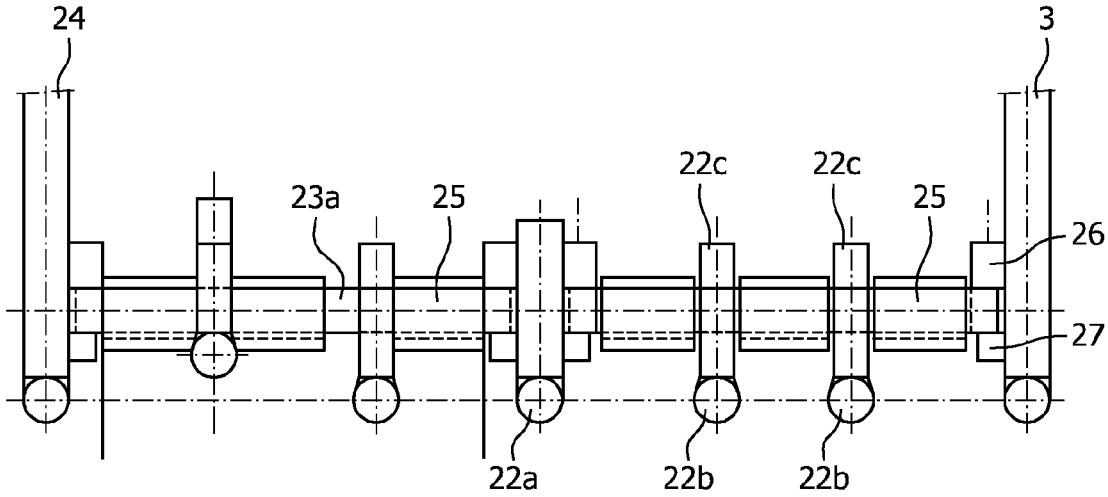
FIG. 4 is a front view of a cross-section along line B-B of the drag head shown in FIG. 1.

Referring to FIG. 2, a first exemplary embodiment of a visor 2 of a drag head according to the invention is shown. Visor 2 is provided with a catching construction 20 for undesirable objects such as for instance large stones, rocks and/or bombs. In the shown variant catching construction 20 is received horizontally in visor 2. This is not essential, and catching construction 20 can run at an angle to the underside of visor 2, or even vertically. As can be clearly seen in FIG. 3, catching construction 20 closes the suction opening with the exception of a number of passage openings 21. What is exceptional about the invented catching construction 20 is that at least a number of passage openings 21 have a variable passage area. In the preferred embodiment shown in FIGS. 2, 3 and 4 this is achieved as follows. Catching construction 20 comprises a framework of rods (22, 23) which run crosswise and between which are situated passage openings 21. Longitudinal rods 22 run in the length direction of visor 2 (during use this direction corresponds to the dragging direction P), while transverse rods 23 run in transverse direction of visor 2. According to the invention at least some of the longitudinal rods 22 and/or transverse rods 23 are connected movably to visor 2. Referring to the variant shown in FIG. 3, the first series of rods connected fixedly to visor 2 is formed by longitudinal rods 22*a*. Transverse rods 23*a* are mounted movably between longitudinal rods 22*a* and connected to the side of the visor. Longitudinal rods 22*a* are for instance welded onto rear wall 3' of visor 2. In the variant shown in FIG. 3 the transverse rods 23*a* are connected movably to side wall 3 and/or fixed longitudinal rods 22*a* by means of a fixing slat 26 on which a locking slat 27 is mounted. A second series of longitudinal rods 22*b* is connected movably to visor 2, and more particularly to transverse rods 23*a* of the first series. As shown in FIG. 2, the coupling between longitudinal rods 22*b* and transverse rods 23*a* is formed by a coupling slat 22*c* (shown by hatching) which is placed over transverse rods 23*a* and which is provided with openings 22*d* such that these can be placed over transverse rods 23*a*. Movable longitudinal rods 22*b* are then welded fixedly to the underside of coupling slat 22*c*. It is also possible to apply a bolt connection for locking slat 27. Such a connection makes the replacement of a possibly damaged longitudinal rod 22*b* and/or transverse rod 23*a* very simple. Openings 22*d* in coupling slat 22*c* ensure that it is slidable in transverse direction over transverse rods 23*a*. Due to the play between openings 22*d* and transverse rods 23*a* a (possibly limited) downward or upward displacement (out of the plane of FIG. 3) is moreover possible. This makes longitudinal rods 22*b* movable. Sleeves or spacer pipes 23 or end stops, between which coupling slats 22*c* can slide, are arranged on the first series of rods 23*a* in order to limit the movement.

It has been found that with catching construction 20 according to the invention significantly fewer undesirable objects become lodged in passage openings 21. This is attributed to the above described 'movable' character of the catching construction. If, despite the improved operation, undesirable objects nevertheless are still left behind in the catching construction during dredging, a method in which the invented drag head is lifted and/or in which the suction action is temporarily reduced or deactivated is generally sufficient to free the catching construction of the undesirable objects. This saves a lot of production time. The increased mobility of the catching construction is evidently sufficient to once more shed objects in simple manner which are firmly lodged due to the strong suction action of the suction pipe. This is surprising since one would precisely expect an object lodged in the catching construction to counteract the mobility of the rods of the catching construction, whereby there would be no difference from a catching construction with only fixed rods.

Figure 5:
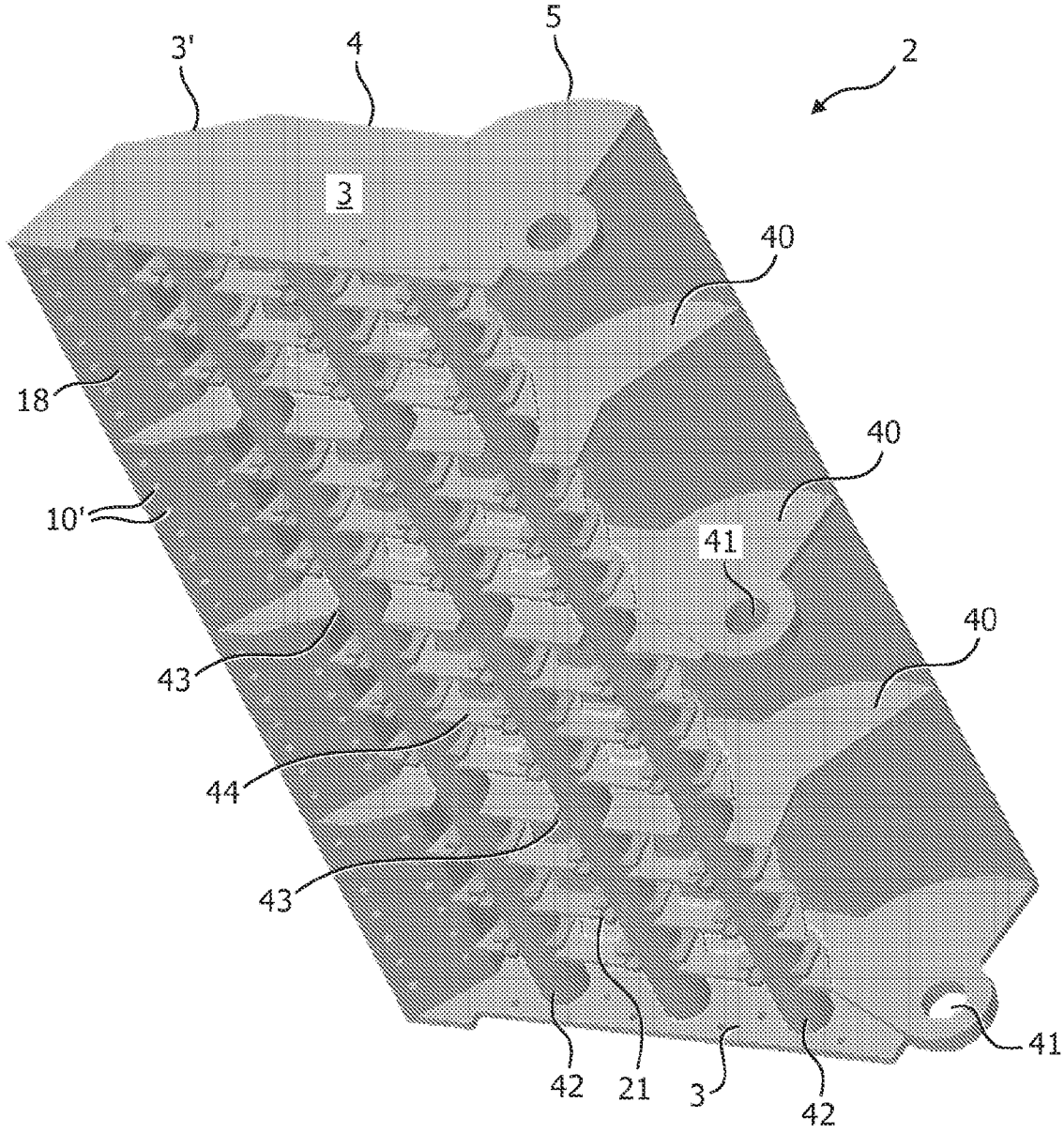
FIG. 5 shows a perspective bottom view of a part of another embodiment of the visor of a drag head according to the invention.
Figure 6:
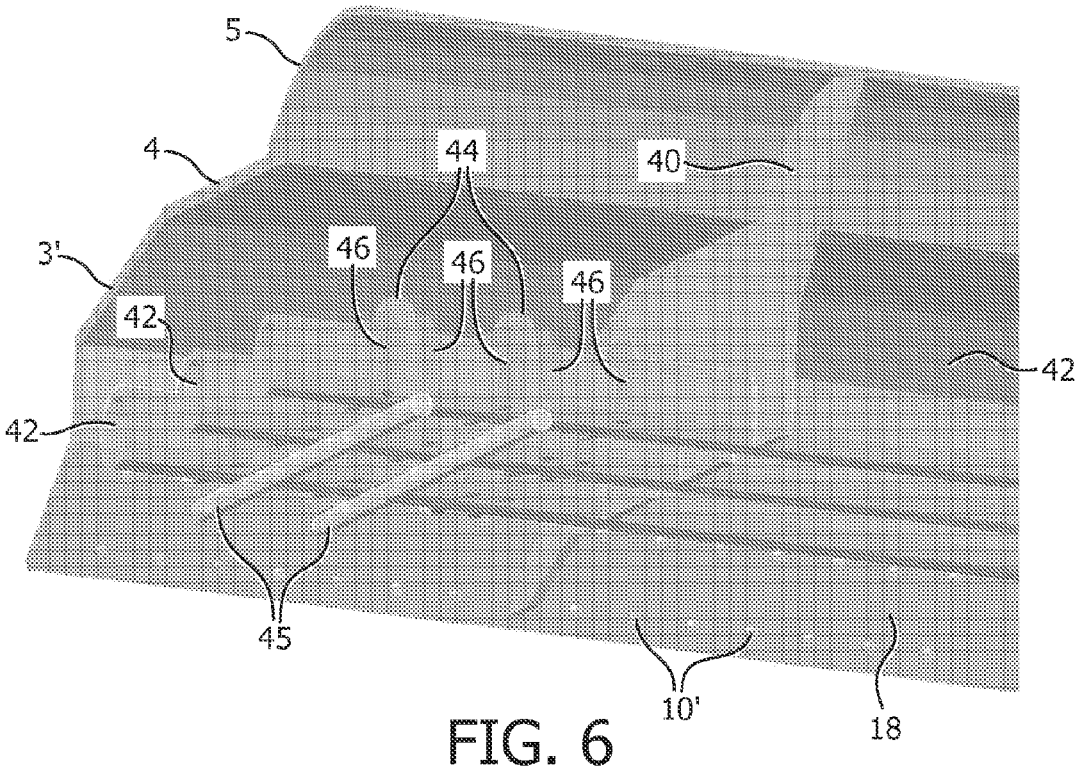
FIG. 6 is a perspective bottom view of a detail of the embodiment variant shown in FIG. 4.

FIG. 5 shows another preferred variant of the invented catching construction. A visor 2 with side walls 3, a top plate 4 with arcuate portion 5 and a rear wall 3' is shown. Visor 2 is provided on the downstream side with a toothed beam 18 which incorporates openings 10' for teeth 10 for mounting. Visor 2 is provided on the inside with a number of strengthening partitions 40, several of which are provided on the upstream side with openings 41 in which rotation shaft 6 (shown in FIGS. 1 and 2) can be received. Three transverse pipes 42 are received in side walls 3 of visor 2. These are dimensioned such that they provide sufficient strength and rigidity for the visor and can also be provided with teeth or other cutting tool. A first series of transverse pipes 42 is received in openings 43 of partitions 40. Movable coupling slats 44 are further received on transverse pipes 42 between fixed partitions 40. These slats are also provided with openings which are pushed over transverse pipes 42. As shown in more detail in FIG. 6, a second series of longitudinal rods 45 is fixed on the underside onto coupling slats 44 (for the sake of clarity longitudinal rods 45 are not shown in FIG. 5). Longitudinal rods 45 are thus connected movably to the first series of transverse pipes 42 by means of a slidable coupling 44. The sliding can take place to limited extent between two end stops 46 arranged on the first series of transverse pipes 42. Catching construction 20 comprises the framework formed by rods 42 and 45 which run crosswise and between which passage openings 21 are situated.

Figure 7:
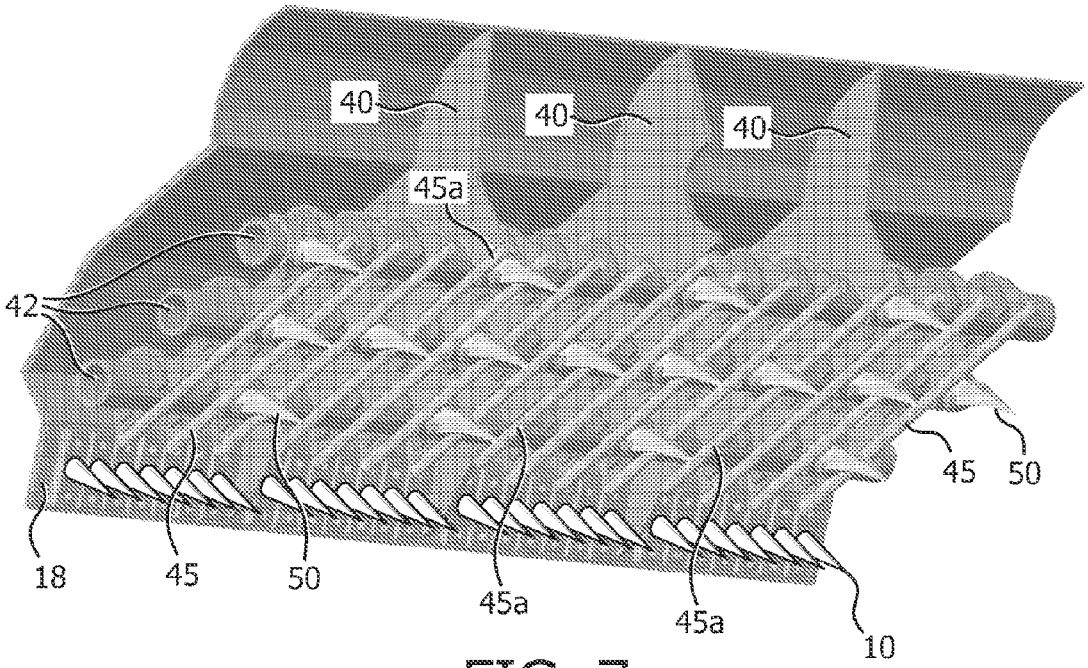

FIG. 7 shows a further preferred variant in which all partitions 40 are provided with fixed longitudinal rods 45*a* and coupling slats 44 with movable longitudinal rods 45. Toothed beam 18 of the drag head is moreover provided with a first series of teeth 10. Transverse pipes 42 of catching construction 20 are likewise provided with a second series of teeth 50.

The invention is not limited to the above described embodiments and also comprises modifications thereto to the extent these fall within the scope of the appended claims.

The invention claimed is

1. Drag head of a trailing suction hopper dredger, comprising a rotatable visor connected to a suction pipe for discharging soil via the suction opening of the visor, wherein the visor is provided with a catching construction for preventing entrance of undesirable objects into said suction pipe, said catching construction includes a framework of rods closing off the suction opening except for passage openings between the rods, and preventing undesirable objects which are larger than the passage openings from entering the suction pipe, wherein at least a number of the passage openings have an adjustable passage area, wherein a first series of rods of said framework of rods is connected fixedly to the visor and a second series of rods of said framework of rods is connected movably to the visor, and wherein the second series of rods is connected movably to the first series of rods by means of a coupling slidable between two end stops arranged on the first series of rods.

2. Drag head as claimed in claim 1, wherein at least a number of passage openings have a passage area which can be enlarged.

3. Drag head as claimed in claim 1, wherein the framework of rods run crosswise and between which the passage openings are situated.

4. Drag head as claimed in claim 3, wherein the second series of rods connected movably to the first series of rods extend in the longitudinal direction of the visor, which corresponds to the direction of dragging.

5. Drag head as claimed in claim 3, wherein the second series of rods connected movably to the first series of rods extend in the transverse direction of the visor.

6. Drag head as claimed in claim 1, wherein the catching construction is provided with a series of teeth.

7. Drag head as claimed in claim 1, wherein the visor is provided at the position of the underside of the side walls with wear strips having a sharp edge, the strips being sufficiently thin to penetrate the ground and thus realize an at least partial lateral sealing.

8. Method for breaking up or dredging at least partially hard grounds under water using a trailing suction hopper dredger equipped with a drag head as claimed in claim 1, wherein the drag head is lifted and the suction action is temporarily reduced or deactivated in order to free the catching construction for preventing entrance of undesirable objects into said suction pipe.

9. Method for breaking up or dredging at least partially hard grounds under water using a trailing suction hopper dredger equipped with a drag head as claimed in claim 1, wherein the drag head is lifted or wherein the suction action is temporarily reduced or deactivated in order to free the catching construction of undesirable objects.

10. Drag head of a trailing suction hopper dredger, comprising a rotatable visor connected to a suction pipe for discharging soil via the suction opening of the visor, wherein the visor is provided with a catching construction for preventing entrance of undesirable objects into said suction pipe, said catching construction including a framework of rods closing off the suction opening except for passage openings between the rods, and preventing undesirable objects which are larger than the passage openings from entering the suction pipe, wherein at least a number of the passage openings have an adjustable passage area, wherein a first series of rods of said framework of rods is connected fixedly to the visor and a second series of rods of said framework of rods is connected movably to the visor, and wherein the second series of rods is connected movably to the first series of rods by means of a coupling slidable between two sleeves arranged on the first series of rods.

11. Drag head as claimed in claim 10, wherein at least a number of passage openings have a passage area which can be enlarged.

12. Drag head as claimed in claim 10, wherein the framework of rods run crosswise and between which the passage openings are situated.

13. Drag head as claimed in claim 12, wherein the second series of rods connected movably to the first series of rods extend in the longitudinal direction of the visor, which corresponds to the direction of dragging.

14. Drag head as claimed in claim 12, wherein the second series of rods connected movably to the first series of rods extend in the transverse direction of the visor.

15. Drag head as claimed in claim 10, wherein the catching construction is provided with a series of teeth.

16. Drag head as claimed in claim 10, wherein the visor is provided at the position of the underside of the side walls with wear strips having a sharp edge, the strips being sufficiently thin to penetrate the ground and thus realize an at least partial lateral sealing.

17. Method for breaking up or dredging at least partially hard grounds under water using a trailing suction hopper dredger equipped with a drag head as claimed in claim 10, wherein the drag head is lifted and the suction action is temporarily reduced or deactivated in order to free the catching construction for preventing entrance of undesirable objects into said suction pipe.

18. Method for breaking up or dredging at least partially hard grounds under water using a trailing suction hopper dredger equipped with a drag head as claimed in claim 10, wherein the drag head is lifted or wherein the suction action is temporarily reduced or deactivated in order to free the catching construction of undesirable objects.

* * * * *